United States Patent [19]

Ide et al.

[11] Patent Number: 4,607,945

[45] Date of Patent: Aug. 26, 1986

[54] IMAGE FORMING APPARATUS

[75] Inventors: Fumito Ide, Zama; Toshiyuki Sogo, Ebina; Kouzou Matsuyama, Yokohama; Shinichi Hashimoto, Fujisawa, all of Japan

[73] Assignee: Kabushiki Kaisha Toshiba, Kawasaki, Japan

[21] Appl. No.: 644,922

[22] Filed: Aug. 27, 1984

[30] Foreign Application Priority Data

Aug. 31, 1983 [JP] Japan ..... 58-159296

[51] Int. Cl.[4] ..... G03G 15/00; G03G 21/00

[52] U.S. Cl. ..... 355/14 R; 355/14 SH

[58] Field of Search ..... 355/3 R, 14 R, 14 SH, 355/3 SH

[56] References Cited

U.S. PATENT DOCUMENTS 4,236,808 12/1980 Tusso et al. ..... 355/14 SH X
4,366,219 12/1982 Beery ..... 355/14 SH X
4,420,246 12/1983 Nonaka et al. ..... 355/14 SH X
4,461,564 7/1984 Ikenoue ..... 355/14 SH X

FOREIGN PATENT DOCUMENTS 3247841 8/1985 Fed. Rep. of Germany .

*Primary Examiner*—Fred L. Braun
*Attorney, Agent, or Firm*—Cushman, Darby & Cushman

[57] ABSTRACT

An image forming apparatus includes a document unit having a document table on which a document is placed and is reciprocated, a photoconductive drum, an exposure unit for exposing the photoconductive drum in order to form a latent image of a document placed on the document table on the photoconductive drum, a developing device for developing the latent image formed on the photoconductive drum into a toner image, a fusing unit for fixing the toner image to a paper sheet and a paper measuring device for measuring the size of the first copying paper sheet sequentially and continuously fed from a paper feeding unit, so that for the following paper sheets, a moving distance of the document unit is determined in cooresponding with the measured paper size.

6 Claims, 15 Drawing Figures

IMAGE FORMING APPARATUS

BACKGROUND OF THE INVENTION

The present invention relates to an image forming apparatus which is used as, for example, an electronic copying machine.

An electronic copying machine comprises a document unit which is reciprocally provided on an upper portion of a console. When the document unit is moved with a document thereon, a photoconductive drum is exposed in accordance with an image on the document, thereby forming an electrostatic latent image on the drum. The thus formed latent image is transferred to paper fed from a paper feeding cassette and is fixed thereon, thus obtaining a copy.

In a copying machine of this type, in order to shorten the copying time in the continuous copying mode, a rear edge of a paper sheet fed from a paper feeding cassette is detected by a sensor switch, and a document unit can be quickly returned in accordance with the paper size.

However, in a recent compact electronic copying machine, when a distance between a paper feeding unit and a transfer unit becomes small, a distance between a switch for detecting the rear edge of the paper and the transfer unit also becomes smaller than a distance between the transfer unit and an exposure unit. For this reason, when a paper size is detected by the switch and then the document unit is returned, the document unit can move for a distance exceeding the detected paper size. Therefore, in the compact copying machine, the document unit cannot be quickly returned, resulting in an undesirably long copying time in the continuous copying mode.

SUMMARY OF THE INVENTION

It is an object of the present invention to provide a compact image forming apparatus which can regulate a relative moving range of a document table and an exposure unit in the image forming mode in correspondence with the paper size.

According to the present invention, an image forming apparatus is provided wherein the paper size of the first paper sheet fed from a paper feeding unit is detected by a sensor, and a relative moving range of a document table and an exposure unit is regulated for the following copies.

DETAILED DESCRIPTION OF THE PREFERRED EMBODIMENT

Figure 1:
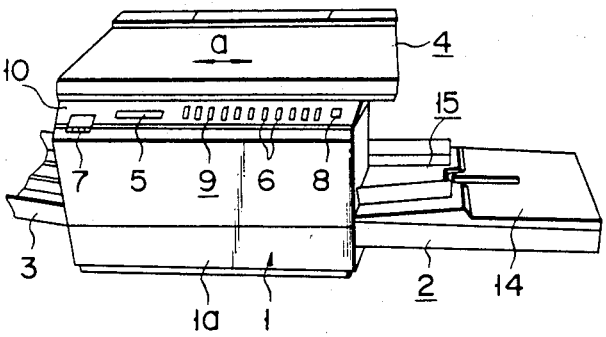
FIG. 1 is a perspective view showing an image forming apparatus according to an embodiment of the present invention.
Figure 2:
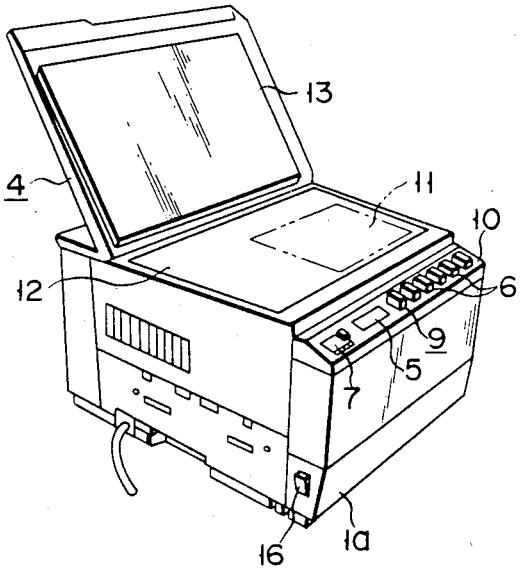
FIG. 2 is a perspective view showing the image forming apparatus when a document unit is opened.

According to an electronic copying machine shown in FIGS. 1 and 2, a paper feeding cassette 2 is loaded in a console 1 at a right side thereof and a paper discharging tray 3 is loaded therein at a left side thereof. A document unit 4 is provided on an upper portion of the console 1 to be reciprocated in a right/left direction (arrow a). An operation board 10 is provided on an upper front portion of the console 1. A display panel 5, input keys 9 such as ten keys 6 and a print key 8, and an exposure setting knob 7 are provided on the operation panel 10.

The document unit 4 comprises a document table (e.g., a glass plate) 12 for placing a document 11 and a document cover 13 for covering the document table 12. A power supply switch 16 is provided on a side surface of the console 1.

Figure 3:
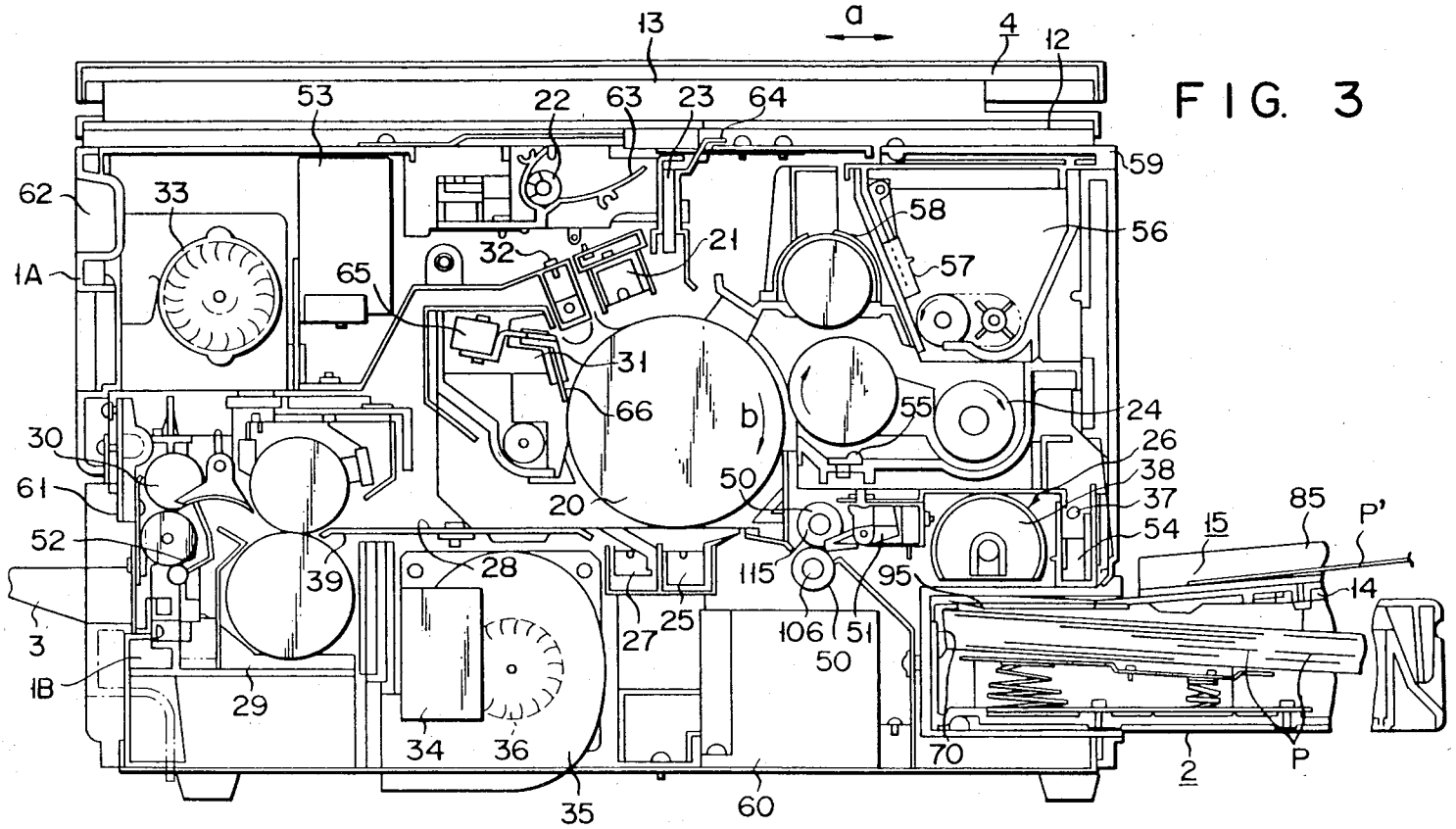
FIG. 3 is a sectional view showing the image forming apparatus of FIG. 1.

According to the construction shown in FIG. 3, an image forming unit 200A comprises a photoconductive drum 20 which is disposed at a substantially central portion of the console 1. The photoconductive drum 20 is driven by a driving unit (not shown) in a direction indicated by an arrow b in synchronism with the document unit 4. The photoconductive drum 20 is uniformly charged by a charger 21. When the document is illuminated with light from an exposure lamp 22, reflected light from the document is converged to the photoconductive drum 20 by a converging light transmitting member (trade name: SELFOC lens array) 23, and an electrostatic latent image corresponding to the document image is thereby formed on the photoconductive drum 20. The latent image is developed into a toner image by a developer 24. The toner image portion of the drum is moved to a transfer charger 25 upon rotation of the photoconductive drum 20. At this time, when a paper sheet P or P′ stored in a paper feeding cassette 14 or a manual paper feeding table 15 is fed to the transfer charger 25 by a paper feeding unit 26, the toner image formed on the photoconductive drum 20 is transferred to the paper sheet P or P′. After the transfer operation, the paper sheet P or P′ is peeled by a paper peeling charger 27 which discharges an AC corona, and is conveyed to a fusing or fixing device 29 by a conveying path 28. The paper sheet P or P′ leaving the fusing device 29 is discharged onto the tray 3 by a paper discharging roller 30.

After the transfer operation, the photoconductive drum 20 is cleaned by a cleaning unit 31 so as to remove residual toner particles thereon, and is further exposed by a charge removing lamp 32 so as to remove residual charges.

A fan 33, as a cooling device, is provided to radiate heat generated from the exposure lamp 22 and the fusing device 29. A power source 34 is cooled by a fan 36 which is mounted on a main motor 35.

In the console 1, upper and lower frames (not shown) are pivotally supported by a shaft 37 at one end portion of each thereof so as to be freely opened/closed at the other end portion of each at a desired angle of, for example, 30 degrees. The charger 21, the converging light transmitting member 23, the exposure lamp 22, the developer 24, the cleaning unit 31, the charge removing lamp 32, and the like which are respectively arranged around the photoconductive drum 20 are mounted on the upper frame. In addition, the fan 33, the paper feeding roller 38 of the paper feeding device 26, and the document unit 4 are mounted on the upper frame. An upper unit 1A comprises the above-mentioned members which are mounted on the upper frame.

On the other hand, the paper feeding cassette 2, the charger 25, the charger 27, the paper discharging roller 30, the tray 3, the main motor 35, the power source 34, and the like are mounted on the lower frame, thereby constructing a lower unit 1B. A front cover 1*a* can be pivoted and removed from the console 1, and the paper sheets jammed at the conveying path 28 can be removed therefrom.

A register roller pair 50 is provided to correct a tilt of a leading end portion of the paper sheet P or P′ which is automatically or manually fed, and to convey the sheet P or P′ to the transfer charger 25 in synchronism with the timing of forming the toner image on the photoconductive drum 20. A manual paper feeding sensor switch 51 is provided immediately before the register roller pair 50.

A paper discharging switch 52 detects that the paper sheet P or P′ having a fixed image thereon is discharged onto the tray 3. A total counter 53 is provided to count the total number of copies produced. A paper empty switch 54 is provided to detect that no paper sheet P is stored in the paper feeding cassette 2. A doctor blade 55 regulates a thickness of a developing agent layer on the developer 24. Toner is fed to a toner hopper 56. When no toner is stored in the toner hopper 56, a toner empty switch 57 is operated. The toner hopper 56 is closed by a hopper cap 59, and when the hopper cap 59 is open, the document unit 4 cannot be operated. A toner density sensor 58 detects a toner density.

In addition, a high-voltage transformer 60, a discharging brush 61, a handle 62 for opening/closing the upper unit 1A, a reflector 63 and a subreflector 64 which surround a back portion of the exposure lamp 22 are provided in the console 1. A weight is mounted on a cleaning blade 66 so as to urge the cleaning blade 66 against the photoconductive drum 20 at a constant pressure.

Figure 4:
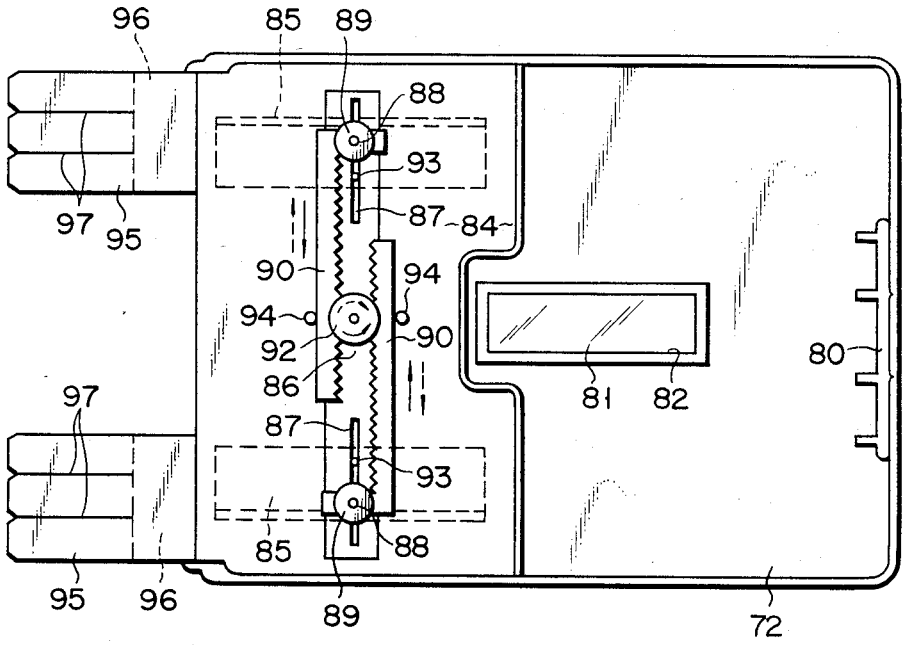
FIG. 4 is a view showing a rear portion of a cassette cover having a manual paper feeding table.

In the manual paper feeding table 15 shown in FIG. 4, a cover case 72 has a connecting portion 80 for connecting a back end portion of a cassette housing 73 with a back end portion thereof, and is freely opened/closed with respect to an upper surface of the cassette housing 73. A window 82 which is closed by a transparent plate 81 is provided at a central portion of the cover case 72 to allow for checking whether or not the paper sheet is stored in the cassette housing 73. An upper surface at a free end portion of the cover case 72 serves as a manual paper feeding guide surface 83. A recess 84 is formed at a lower surface side of the manual paper feeding side surface 83. Guide plates 85 are provided as a width regulating member for guiding two ends of the paper sheet P′, which is manually fed. The guide plates 85 are supported by a supporting mechanism 86 stored in the recess 84. When one of the guide plates 85 is positioned at a desired position, the other guide plate 85 can be automatically positioned. The guide plates 85 are engaged with upper portions of screws 88 which are screwed from a lower surface side through respective slits 87 formed in the manual paper feeding guide surface 83. In this case, the screws 88 sequentially extend through respective washers 89 and racks 90 which are stored in the recess 84. The racks 90 are engaged with a pinion 92 which is pivotally mounted on a shaft 91.

When one of the guide plates 85 is moved in an inward direction (i.e., a direction indicated by the arrow of the solid line), this movement is transmitted to one of the racks 90 through one of the screws 88, and the linear movement of the rack 90 is transmitted to the other rack 90 as a linear movement. Then, the other guide plate 85 is thereby moved inward. On the other hand, when one of the guide plates 85 is moved in an outward direction (i.e., a direction indicated by the arrow of the short dashed line), the other guide plate 85 is also moved outward.

Rotation stop pins 93 abut against the lower surfaces of the guide plates 85 in the respective slits 87 so that the guide plates 85 are maintained to be parallel to each other. The racks 90 are guided by guide pins 94 so as to securely engage with the pinion 92.

Figure 5:
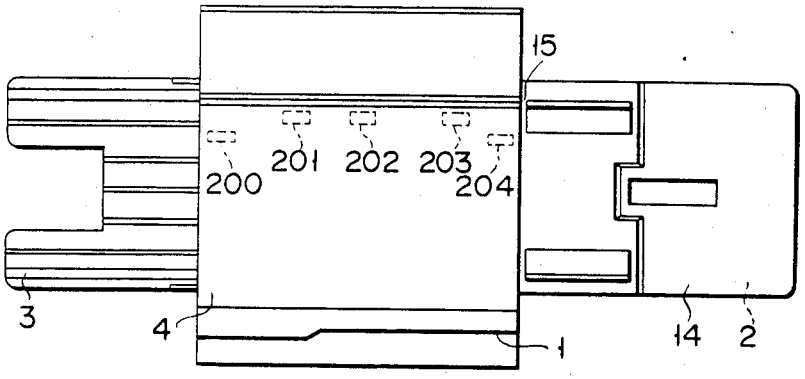
FIGS. 5 to 8 are, respectively, views showing the relationship between the document unit and a document unit switch during the copying operation.

As shown in FIG. 5, five magnets 200 to 204 are provided below the document table (i.e., the glass plate) 15 of the document unit 4. The five magnets are the magnet 200 for detecting a document unit limit position, the magnet 201 for detecting a document unit home position, the magnet 202 for detecting a paper start position, and the magnets 203 and 204 for detecting a document start position.

Figure 6:
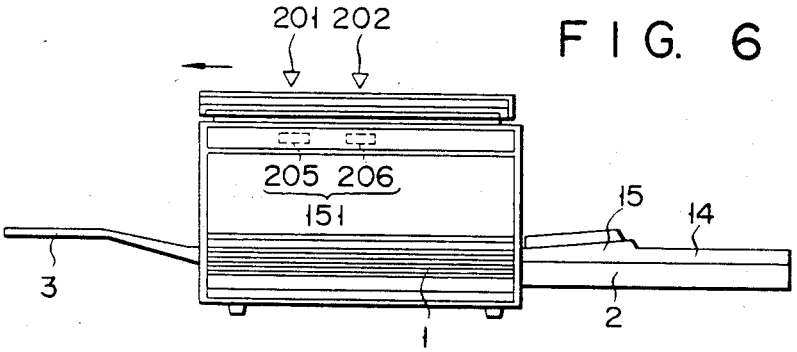

The magnets 201 to 203 are linearly arranged at a back side of the glass plate 15, and the magnets 200 and 204 are linearly arranged at a position slightly shifted from the row of the magnets 201 to 203 toward a front side. The magnets 200 to 204 are detected by lead switches 205 and 206 shown in FIG. 6. The lead switches 205 and 206 constitute a document unit switch assembly 151. FIG. 6 shows the state wherein the document unit 4 is at a home position. Note that the document unit 4 returns to the home position after the copying operation. In this case, the magnet 201 is detected by the lead switch 205.

Figure 7:
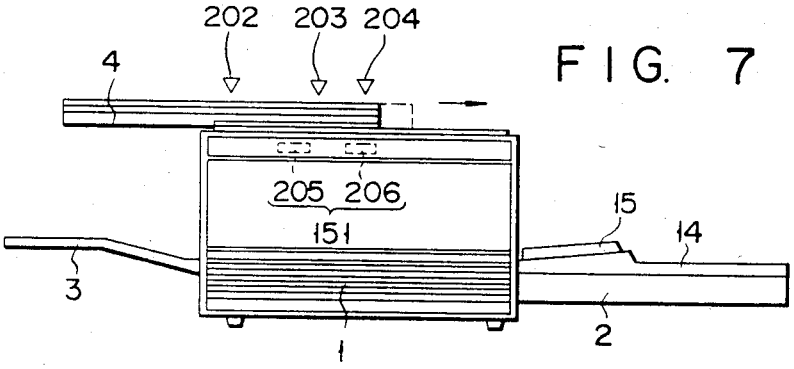

FIG. 7 shows a start position of the document unit 4. In this case, two magnets 203 and 204 for detecting the document unit start position are simultaneously detected by the lead switches 205 and 206. The exposure operation of the document starts at this time, and the document unit 4 is moved in the direction indicated by the arrow in FIG. 7. When the magnet 202 is detected by the switch 205 upon the movement of the document unit 4, a microprocessor 154 operates a register roller solenoid 124 in response to a detection signal therefrom. Then, the register roller pair 50 is rotated, thereby feeding the paper sheet to the transfer unit.

Figure 8:
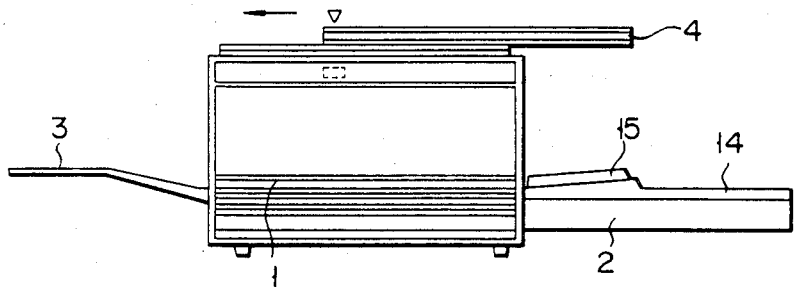

When the document unit 4 is further moved to the position shown in FIG. 8, the magnet 200 is detected by the switch 206, thereby checking a limit position of the document table 12. The document unit 4 is moved in a direction indicated by the arrow from the limit position.

In this manner, the position of the document unit 4 is detected by signals from the switches 205 and 206, and the microprocessor 154 selectively operates a document unit clutch 163, thereby reciprocating or stopping the document unit 4.

Figure 9:
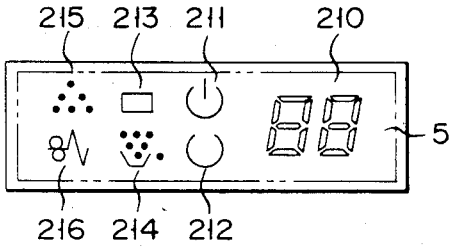
FIG. 9 is a plan view showing a display panel.

On the display panel 5 shown in FIG. 9, a display segment 210 for displaying the number of copied paper sheets, a display segment 211 for displaying a waiting state (the copying operation cannot be performed), a display segment 212 for displaying a ready state (the copying operation can be performed), a display segment 213 for displaying a paper empty state, a display segment 214 for displaying that overflow of the recovered toner has occurred, a display segment 215 for displaying that no toner is stored in the toner hopper 56, and a display segment 216 for displaying a paper jam state are provided.

Figure 10A:
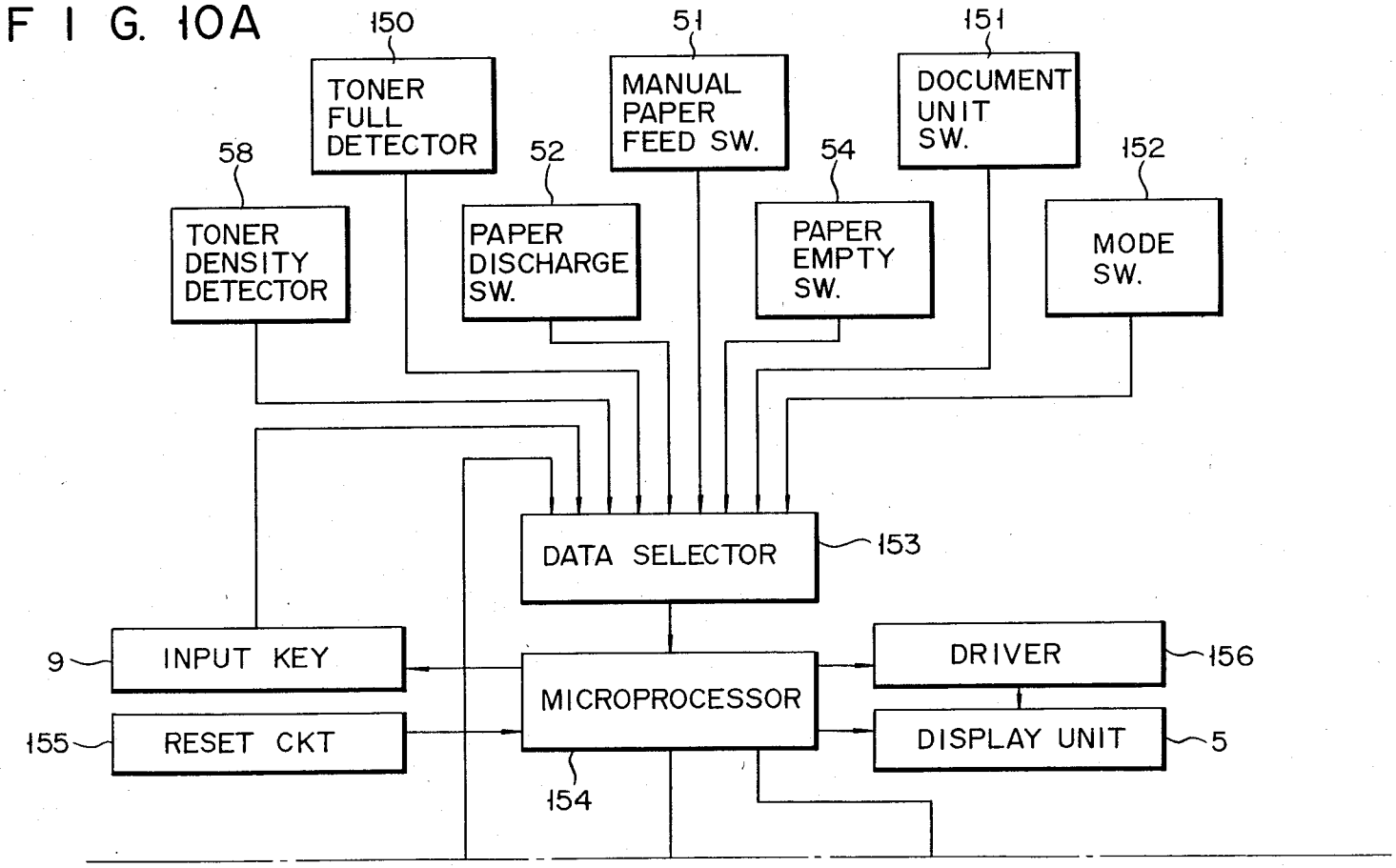
FIGS. 10A and 10B are a block diagram of the image forming apparatus.
Figure 10B:
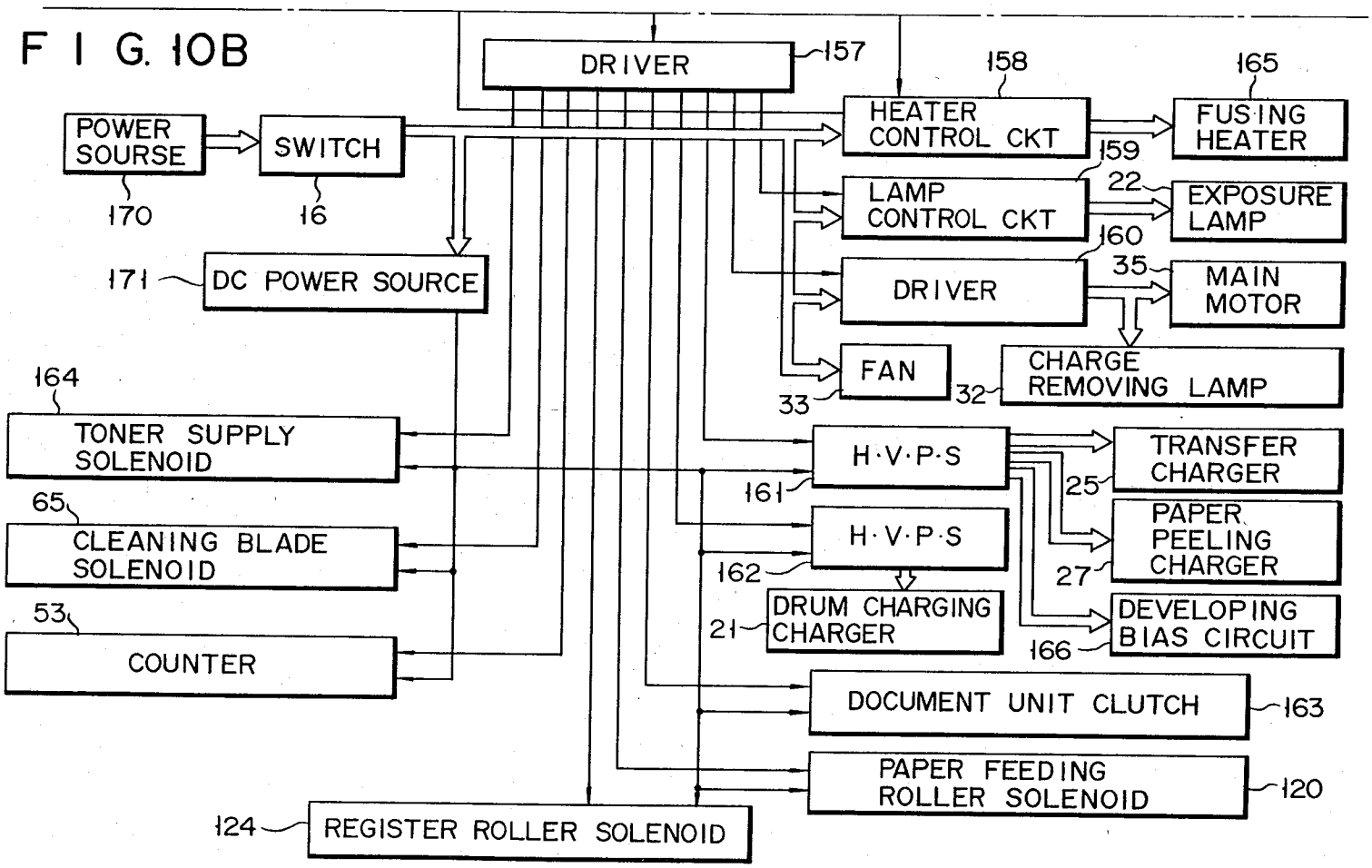

According to a block diagram of the electronic copying machine shown in FIGS. 10A and 10B, the toner density sensor 58, a toner full sensor 150, the paper discharging switch 52, the manual feed detection switch 51, the paper empty switch 54, the document unit switch assembly 151, and a mode switch 152 are coupled to the microprocessor 154 through a data selector 153. The microprocessor 154 is further connected to the diplay panel 5 directly and through a driver 156, and is connected to the input keys 9, a reset circuit 155, and a heater control circuit 158. Output terminals of a driver 157 which is coupled to the microprocessor 154 are respectively connected to a toner replenishment solenoid 164, a cleaner solenoid 65, the counter 53, the register roller solenoid 124, a paper feeding roller solenoid 120, a document unit solenoid 163, high-voltage power souces 161 and 162, a driver 160, and a lamp control circuit 159.

A power source 170 supplies power to a DC power source 171 and the fan 33 and also supplies power to a fusing heater 165, the lamp 22, the main motor 35, and the charge removing lamp 32 through the heater control circuit 158, the lamp control circuit 159, and the driver 160, respectively. Outputs of the high-voltage power source 161 are respectively coupled to the transfer charger 25, the paper peeling charger 27 and a developing device bias circuit 166. The high-voltage power source 162 supplies power to the charger 21.

The mode switch 152 can selectively set a normal mode, an aging mode, a check mode and a forced ready mode. The normal mode is a normal copying mode. When the aging mode is set by the mode switch 152, the segment 210 displays "AG", and the normal copying operation is repeated except for the paper feeding operation, thereby aging the copying machine. The aging mode can be released by the operation of a clear/stop key. When the check mode is set, the display segment 210 displays "CH", and various data supplied to the microprocessor 154 through the data selector 153 are checked. Then, a display corresponding to an input state is performed by a light-emitting diode (not shown), and an output state of the microprocessor 154 is also checked. The check mode can be released by the operation of the clear/stop key. When the forced ready mode is set, a ready state is displayed before the fusing heater 165 reaches a predetermined temperature at which the fusing operation can be performed. These modes are controlled in accordance with a program stored in a memory stored in the microprocessor 154.

The operation of the electronic copying machine according to the embodiment of the present invention will be described in accordance with the above-mentioned circuit.

When the power switch is turned on, power is supplied from the power source 170 to respective portions. In this case, the microprocessor 154 fetches input data from an input portion, i.e., the switch through the data selector 153, and checks any malfunction. When no malfunction is detected, the copying machine starts the copying operation in accordance with the mode set by the mode switch 152.

Figure 11A:
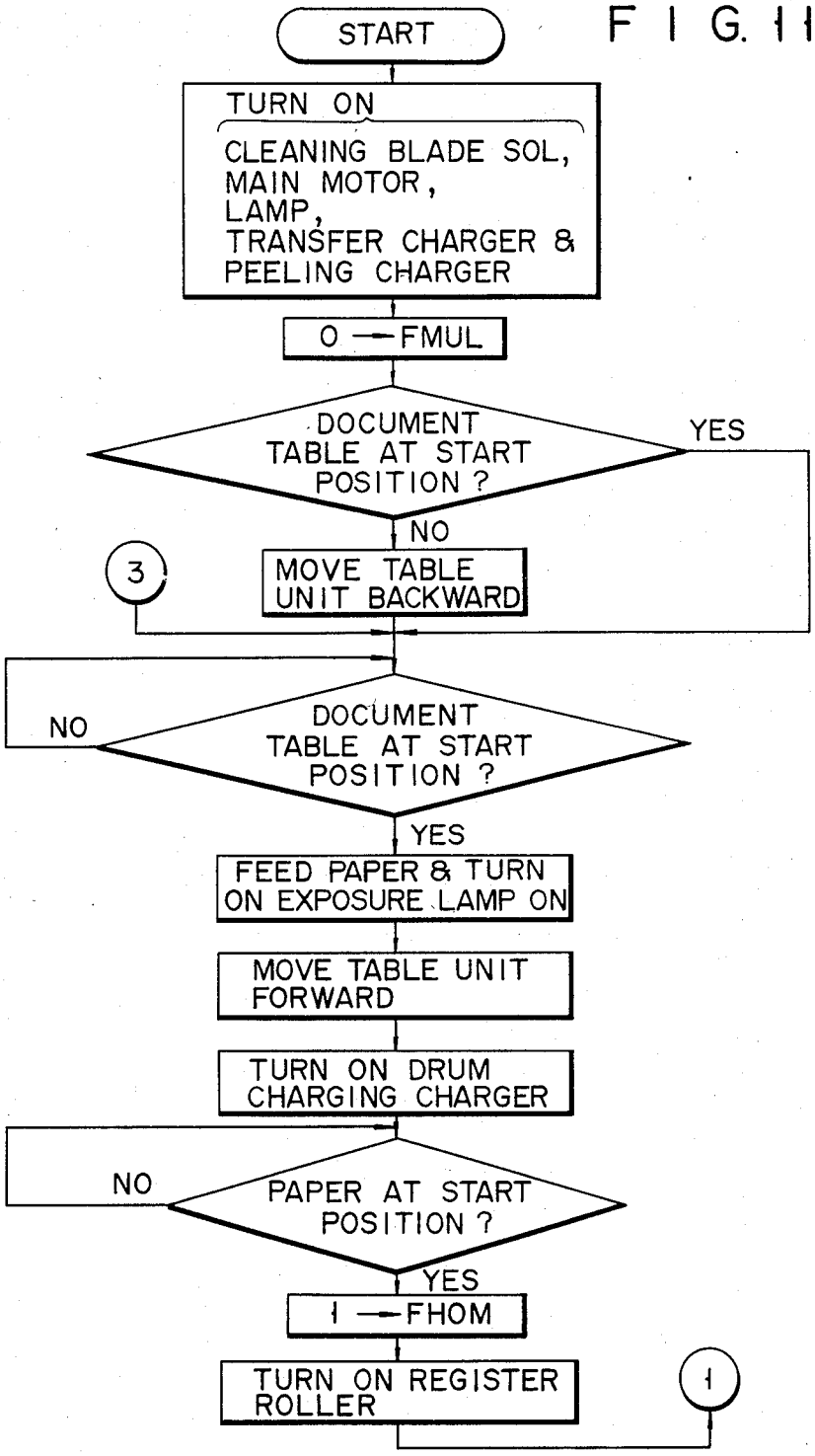
FIGS. 11A to 11C and 12 are respective flow charts showing the operation of the image forming apparatus of FIGS. 10A and 10B.
Figure 11B:
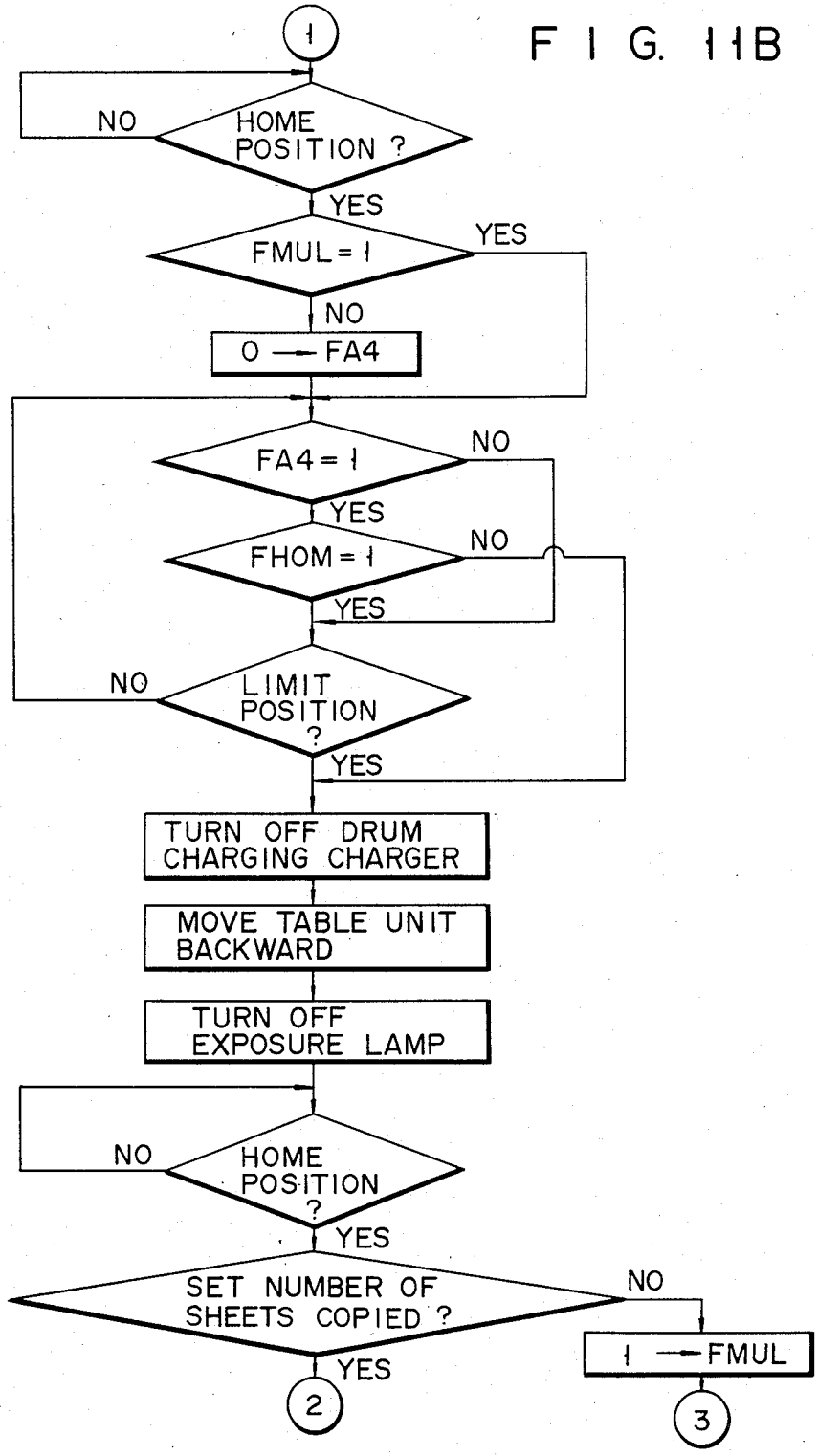

In the normal copying mode, when the number of copied paper sheets is set by the ten keys 6 and then the print key 8 is depressed, the copying operation starts. In this case, as in flow charts of FIGS. 11A to 11C, the microprocessor 154 operates the main motor 35 and the cleaner blade solenoid 65 through the driver 157, illuminates the charge removing lamp 32, and applies a high voltage from the high-voltage power source 161 to the transfer charger 25 and the paper peeling charger 27. Thereafter, the microprocessor 154 resets a multicopy flag FMUL to "0" and checks whether or not the document unit 4 is at the start position. When this determination result is NO, the document unit clutch 163 is operated to move the document unit 4 backward. When the document unit 4 is at the start position, the paper feeding solenoid 120 and the exposure lamp 22 are respectively energized. Therefore, the paper sheet P is fed from the paper feeding cassette 2, and the exposure lamp 22 is illuminated.

Next, the document unit 4 is moved in a forward direction, and the high-voltage power source 162 applies high voltage to the charger 21, thereby starting the exposure operation and the charging operation of the photoconductive drum 20. When the document unit 4 is continuously moved in the forward direction and the microprocessor 154 detects by a signal from the document unit switch assembly 151 that the document unit 4 is at the paper start position, the microprocessor 154 sets a home position flag FHOM to "1" and operates the register roller solenoid 124 through the driver 157. Then, the register roller pair 50 feeds the paper sheet P to the transfer unit.

When the microprocessor 154 detects by a signal from the document unit switch assembly 151 that the document unit 4 is at the home position, it determines whether or not the flag FMUL is set to "1". Since the flag FMUL is "0" when the copying operation starts, a paper size flag FA4 is reset to "0". Therefore, after checking whether or not the flag FA4 is "1", the microprocessor 154 determines whether or not the document unit 4 is at the limit position. If this determination result is YES, the charger 21 is turned off, and the document unit 4 is moved in a backward direction by the document unit clutch 163. After turning off the exposure lamp 22, the microprocessor 154 determines whether or not the document unit 4 is at the home position. If this determination result is YES, the microprocessor 154 determines whether or not the copies of preset number have been obtained. Since this determination result is NO, the flag FMUL is set to "1", and the flow returns to the flow 3 (i.e., the flow for determining the position of the document unit 4). Then the next copying operation starts.

Figure 12:
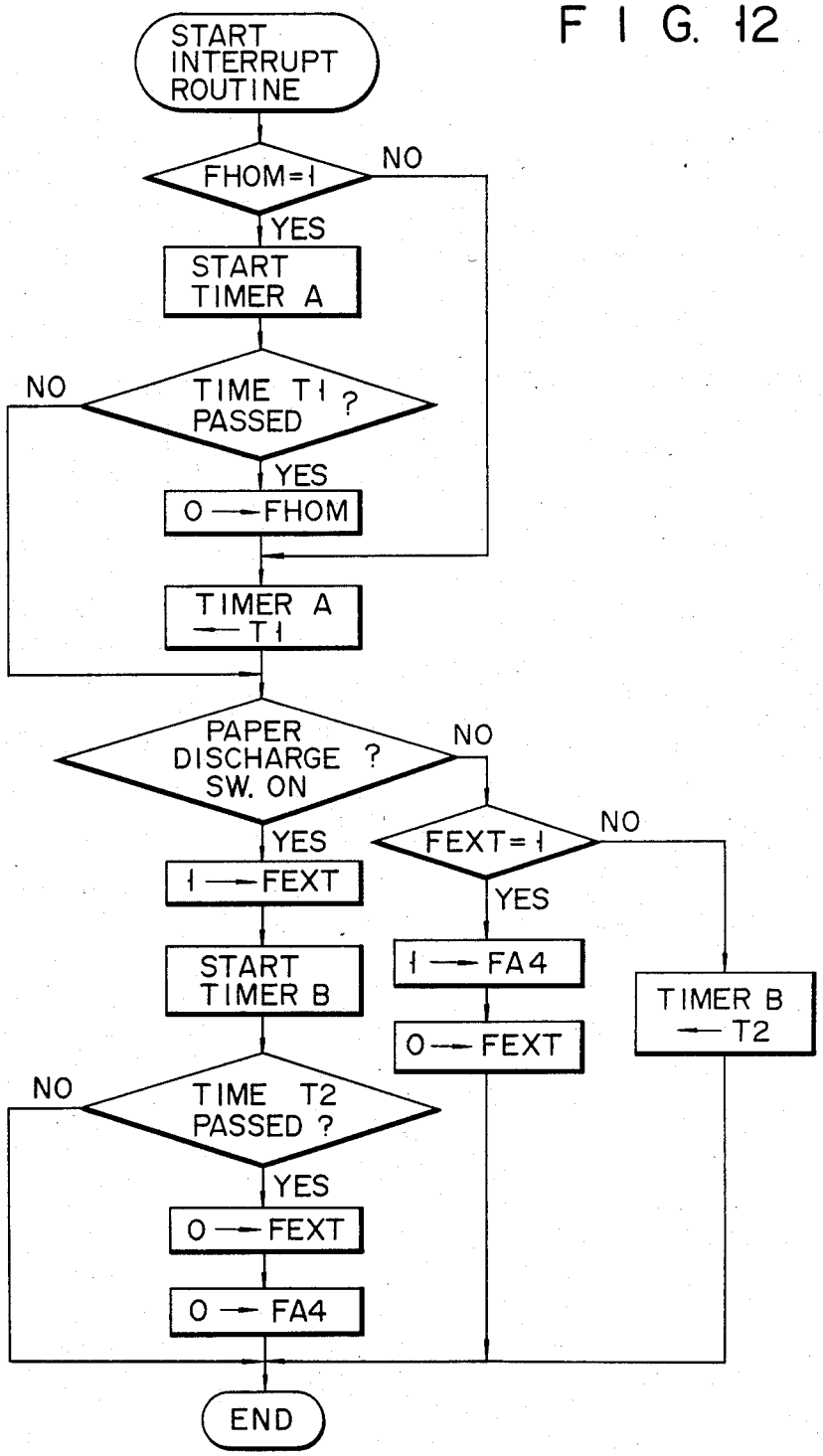

In the above normal copying routine, an interrupt routine for detecting the size of the paper sheet P (FIG. 12) is executed, for example, every 12 msec. In this interrupt routine, the microprocessor determines whether or not the flag FHOM is "1". If this determination result is NO, a time T1 is set in a timer A. It should be noted that the time T1 means a time necessary for performing the exposure operation of an A4 size document from the paper start position. If the determination result of the flag FHOM="1" is YES, the counting operation of the timer A starts. When the timer A begins to count, the flag FHOM is reset to "0", and the time T1 is set in the timer A1 again. Thereafter, the microprocessor 154 determines whether or not the paper discharging switch 52 is turned on. If the determination result is NO, the microprocessor 154 determines whether or not a flag FEXT is "1". If this determination result is NO, a timer B is set at time T2. Note that the time T2 means a time at which the A4 size paper sheet passes through the discharging switch 52 and corresponds to the A4 size. If the determination result is YES, the flag FA4 is set to "1", and hereafter the flag FEXT is reset to "0".

When the paper discharging switch 52 is turned on, the flag FEXT is set to "1", and the timer B starts the counting operation. When the counting value of the timer B exceeds the time T2, the flags FEXT and FA4 are respectively reset to "0", and thereafter the interrupt routine ends. When the counting value of the timer B is the time T2 or less, the interrupt routine immediately ends. When the counting value of the timer B is the time T2 or less, it represents the A4 size paper sheet, and when it exceeds T2, it represents that the size of the paper sheet exceeds the A4 size. Therefore, when the flag FA4 is not "1", the document unit 4 is moved up to the limit position. On the other hand, when the flag FA4 is "1" and the flag FHOM is not "1", the charger 21 is turned off, and thereafter the document unit 4 is moved in the backward direction. In other words, the document unit 4 is not fully moved, but returns to the home position from the position at which the A4 size is scanned.

To summarize, in the multicopying mode, when the first copying operation is performed, the document unit 4 is fully moved in order to measure the size of the paper sheet. However, when the following copying operation is performed, the moving range of the document unit 4 is regulated in correspondence with the size of the paper sheet P. When the size of the paper sheet P is the A4 size or smaller, the document unit 4 reciprocates for a distance corresponding to the A4 size. However, when the size of the paper sheet P exceeds the A4 size, the document unit 4 reciprocates fully. Therefore, when the paper size is small in the continuous copying mode, the continuous copying operation can be performed at a considerably high speed.

Figure 11C:
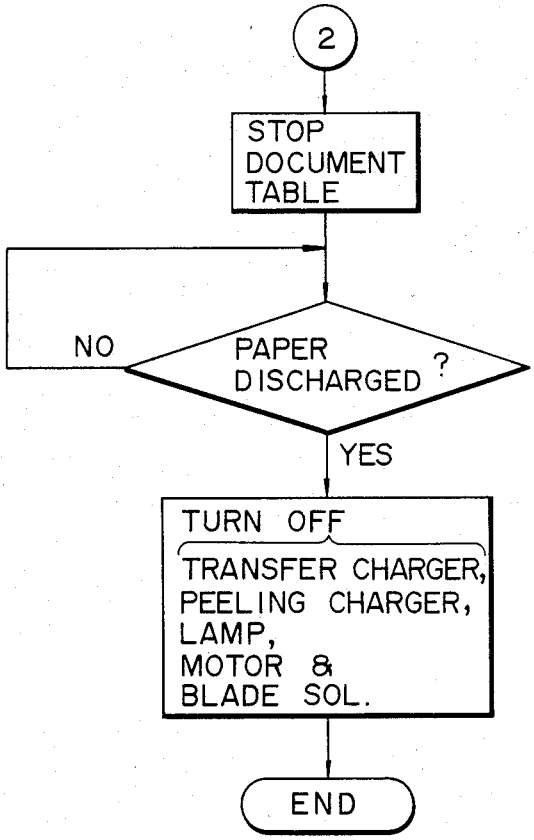

The continuous copying operation is performed in the above manner. When the preset number of copies is obtained, the operation of the document unit 4 is stopped as shown in the flow of FIG. 11C. Thereafter, when the last discharging operation is performed, the transfer charger 27, the charge removing lamp 32, the main motor 35, and the cleaner blade solenoid 65 are respectively de-energized. Then, the copying machine is in the next copying operation standby mode.

In the above embodiment, the A4 size is used as a reference size, but other sizes can be the reference sizes. For example, a plurality of the reference sizes, e.g., B5, A3, B4, A4, etc. can be set.

As described above, according to the present invention, the size of the paper sheet fed from the paper feeding unit is detected, and thereafter the moving distance of the document unit is determined in correspondence with the size of the paper sheet. Therefore, in the continuous copying mode, the copying time can be shortened considerably.

What is claimed is:

1. An image forming apparatus comprising:

document placing means having a document table on which a document is placed;

table position detecting means for detecting a table home position, an exposure start position, a paper start position and a table limit position, said position detecting means including first switch means for detecting the table home position to produce a home position signal, second switch means for detecting the exposure start position to produce an exposure start signal, third switch means for detecting a paper start position to produce a paper start signal, and fourth switch means for detecting the table limit position to produce a limit position signal;

image forming means including a photoconductive member and exposure means operated in response to the exposure start signal for exposing said photoconductive member to form on said photoconductive member an image of said document placed on said document table;

moving means for moving said document table in a first direction for scanning the document and a second direction reversed to the first direction for returning the document table to the start position;

transfer means for transferring the image formed on said photoconductive member onto a paper sheet;

paper feeding means operated in response to the paper start signal to feed the paper sheet to said transfer means;

paper size measuring means for measuring a size of the paper sheet which is fed first, to obtain a size information, said measuring means including a switch means actuated by the leading edge of the paper and means for measuring the size of the paper from the leading edge of the paper to the trailing edge of the paper in response to the detection of the paper leading edge; and control means for controlling said moving means in response to the size information in order to move said document table, moved in the first direction, in the second direction from a position corresponding to the size of the paper sheet obtained from said paper measuring means.

2. An apparatus according to claim 1, wherein said switch means of said paper size measuring means comprises a paper discharging switch disposed on a position passed through said transferring means.

3. An apparatus according to claim 1, wherein said paper size measuring means includes means for counting the turn-on duration of said switching means and means for producing a signal representing a predetermined size of the paper in response to a predetermined value of said counting means.

4. An apparatus according to claim 1, wherein said start switch means comprises two switch elements simultaneously turned on when said document table is at the start position.

5. An apparatus according to claim 1, which includes a manual paper feeding table comprising a manual paper feeding guide surface on which the paper is inputted and two guide plates for guiding two ends of the paper manually fed, which are movable in a width direction of the paper.

6. An apparatus according to claim 1, wherein said table position detecting means comprises three first magnets linearly arranged at a back side of said document table and two second magnets linearly arranged at a position slightly shifted from the arrangement of the first magnets and at least two lead switches actuated by said first and second magnets, two of said first magnets actuating said at least two lead switches at the start position of said document table while the remaining one of said first magnets actuates one of said at least two lead switches at the paper feeding position thereof, and said second magnets actuate said at least two lead switches at the limit position of said document table.

* * * * *